US005501238A

United States Patent [19]

Von Borstel et al.

[11] Patent Number: 5,501,238

[45] Date of Patent: Mar. 26, 1996

[54] CIGARETTE FILTER CONTAINING A HUMECTANT

[76] Inventors: Reid W. Von Borstel, 10301 S. Glen Rd., Potomac, Md. 20854; Craig Lesser, 10724 Wilshire Blvd. #810, Los Angeles, Calif. 90024

[21] Appl. No.: 363,975

[22] Filed: Dec. 23, 1994

Related U.S. Application Data

[63] Continuation of Ser. No. 2,951, Jan. 11, 1993, abandoned.

[51] Int. Cl.[6] ..... A24D 3/00

[52] U.S. Cl. ..... 131/331

[58] Field of Search ..... 131/331–334, 131/345, 359

[56] References Cited

U.S. PATENT DOCUMENTS

| | | | |
|---|---|---|---|
| 3,313,305 | 4/1967 | Noznick et al. . | |
| 3,658,070 | 4/1972 | Diluzio . | |
| 3,674,540 | 7/1972 | Pergaminos . | |
| 3,884,246 | 5/1975 | Walker . | |
| 3,886,955 | 6/1975 | Johnson et al. . | |
| 3,982,897 | 9/1976 | Scheinberg . | |
| 4,037,607 | 7/1977 | Grossman . | |
| 4,076,031 | 2/1978 | Grossman . | |
| 4,092,333 | 5/1978 | Mookherjee et al. . | |
| 4,096,158 | 6/1978 | Evers et al. . | |
| 4,126,708 | 11/1978 | Mookherjee et al. . | |
| 4,138,413 | 2/1979 | Mookherjee et al. . | |
| 4,156,431 | 5/1979 | Epstein et al. . | |
| 4,194,517 | 3/1980 | Borowski . | |
| 4,248,251 | 2/1981 | Bryant, Jr. et al. . | |
| 4,257,430 | 3/1981 | Collins et al. . | |
| 4,258,730 | 3/1981 | Tsukamoto . | |
| 4,260,523 | 4/1981 | Tsukamoto . | |
| 4,333,484 | 6/1982 | Keritsis . | |
| 4,438,775 | 3/1984 | Mays et al. | 131/300 |
| 4,489,739 | 12/1984 | Mattina, Jr. et al. . | |
| 4,506,684 | 3/1985 | Keritsis . | |
| 4,508,525 | 4/1985 | Berger . | |
| 4,532,947 | 8/1985 | Caseley . | |
| 4,537,204 | 8/1985 | Gaisch et al. . | |
| 4,612,942 | 9/1986 | Dobberstein et al. . | |
| 4,761,277 | 8/1988 | Valdes et al. . | |
| 4,763,674 | 8/1988 | Lelah | 131/332 X |
| 4,896,683 | 1/1990 | Cohen et al. . | |
| 4,946,968 | 8/1990 | Krimmer et al. . | |
| 4,964,426 | 10/1990 | Lee et al. . | |
| 5,009,239 | 4/1991 | Cohen et al. | 131/332 X |
| 5,058,607 | 10/1991 | Carter et al. . | |
| 5,060,672 | 10/1991 | Irimi et al. . | |
| 5,218,096 | 6/1993 | Shibuya et al. | 536/41 |
| 5,249,588 | 10/1993 | Brown et al. | 131/291 |

FOREIGN PATENT DOCUMENTS

| | | | |
|---|---|---|---|
| 2702234 | 7/1978 | Germany | 131/270 |
| 57-138375 | 8/1982 | Japan . | |
| 1435504 | 5/1976 | United Kingdom . | |

*Primary Examiner*—Jennifer Bahr

*Attorney, Agent, or Firm*—David A. Farah; Sheldon & Mak, Inc.

[57] ABSTRACT

A cigarette filter has a humectant, preferably sodium pyroglutamate, and optionally a surfactant. The humectant absorbs moisture from the tobacco smoke for wet-filtration of the tobacco smoke.

10 Claims, No Drawings

CIGARETTE FILTER CONTAINING A HUMECTANT

This is a continuation of application Ser. No. 08/002,951 filed on Jan. 11, 1993, now abandoned.

BACKGROUND

The present invention relates to improvements in a filter for tobacco smoke.

It is widely known that tobacco smoke contains toxic and mutagenic components which are harmful to smokers. Conventional cellulose acetate filters, with or without additional activated charcoal, are ineffective in reducing the capacity of cigarette smoke to elicit mitotic abnormalities in test systems, when compared to unfiltered cigarettes (Sabharwal PS et al., *Mutat Res,* 1975 1:217–24). Since conventional filters provide little protection, there exists a need to provide filters with the capacity to reduce the amounts of cytotoxic materials in cigarette smoke.

There have been many attempts over many years to develop cigarette filters which can reduce the toxicity of tobacco smoke. A variety of filter compositions and additives have been suggested for selective removal of particular classes of toxic smoke components.

A strategy for improving the efficacy of tobacco smoke filters is wet filtration, in which a moistened filter (generally in a plastic holder in which a cigarette is inserted) is used to reduce smoke toxicity. The water increases the capacity of the filter to remove smoke components during passage. For example, there is presently on the market a product called "Aqua Filter" which comprises a cigarette holder containing a filter or cartridge which is prewet with a fluid containing water. In order that the fluid or water will not evaporate between the time of manufacture and the time of use, the reservoir, container or cigarette holder having the filter therein has its ends sealed by an insert at the cigarette end and a plastic top at the mouthpiece end. These parts must be removed at the time the holder is used for the smoking of a cigarette. Also, the manufacturer recognizes that the seal provided at each end of the holder may not be effective, and it is suggested that if some of the moisture has evaporated when the product is ready for use, the filter insert may be re-moistened by putting the large end under a faucet. It is apparent that it is essential to provide suitable means for sealing in order not to lose the fluid or moisture by evaporation or otherwise. The provision of the sealing means increase the cost of the parts and the cost of assembling the parts with the cigarette holder.

Glycerol has been proposed for use as wetting agents to improve smoke filtration (U.S. Pat. No. 3,674,540). Glycerol is a liquid, however, which hinders its commercial use in conventional paper-encased filters in amounts sufficient to significantly improve retention of smoke components in filters.

Another approach has been to incorporate water/methylated silica complexes into filter material, where the complexes break down under the heat of smoke passing through the filter to liberate water, which then moistens the filter material (U.S. Pat. No. 4,076,031). The feasibility of this approach, however, is contingent upon the stability of the silica-water complex.

Another approach to wet filtration has been a proposal to incorporate a liquid-containing module in the filter, which module can be ruptured mechanically by the smoker to release moisture into the filter (Japanese Patent Document 62022583-A).

In view of the prior art, there is a need for an efficient wet filtration system for tobacco smoke, which can be used with existing filter materials, but does not break down during heat, does not create health problems, is dependable, and is convenient to use.

SUMMARY

The present invention is directed to a filter, which can be provided by itself or in combination with divided tobacco, that meets this need. The filter comprises a porous substrate having dispersed therein a humectant, preferably sodium pyroglutamate. The hydrophilic humectant absorbs moisture from the tobacco smoke and thus serves to wet-filter the tobacco smoke.

Preferably the filter also comprises one or more substantially nontoxic surfactants, such as polyoxyethylene ethers, polyoxyethylenesorbitan esters, sorbitan esters, polyglycol ethers, sodium cholate, or sodium deoxycholate, to improve the ability of the humectant to absorb moisture and to scrub the tobacco smoke.

To protect the user from water released by the humectant, preferably the filter comprises a water-impervious barrier around the porous substrate.

These and other features of the present invention will become better understood from the following description and appended claims.

DESCRIPTION

A cigarette filter according to the present invention comprises a porous substrate and a humectant. The porous substrate can be any non-toxic material commonly used in cigarette filters, and into which the humectant can be incorporated. Such materials include cellulosic fiber such as a cellulose acetate, cotton, and paper; ion exchange materials; and the like.

The humectant material is capable of absorbing moisture from tobacco smoke, and releasing it to the porous substrate for wet-filtering the tobacco smoke. One or more humectants can be used, including but not limited to glycerol, sorbitol, propylene glycol, sodium lactate, calcium chloride, potassium phosphate, sodium pyrophosphate or sodium polyphosphate, calcium citrate, calcium gluconate, potassium citrate, potassium gluconate, sodium tartrate, sodium potassium tartrate, and sodium glutamate.

The preferred humectant is sodium pyroglutamate, which is non-toxic, effective at temperatures of tobacco smoke, and is effective in removing charged particles from tobacco smoke. Sodium pyroglutamate, also known as sodium 2-pyrrolidone-5-carboxylate, has the structure:

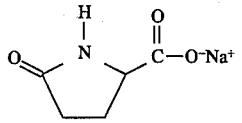

Preferably the humectant is present in an amount of from about 5 to about 60% by weight of the filter.

The filter can optionally contain a surfactant material to improve the effectiveness of the humectant in wet-scrubbing of the tobacco smoke. This includes one or more of a class described as (1) a polyoxyalkylene derivative of a sorbitan fatty acid ester (i.e., polyoxyalkylene sorbitan esters), (2) a fatty acid monoester of a polyhydroxy-alcohol, or (3) a fatty acid diester of a polyhydroxy alcohol. Suitable surfactants can include, for instance, ethoxylates, carboxylic acid esters, glycerol esters, polyoxyethylene esters, anhydrosorbitol esters, ethoxylated anhydrosorbitol esters, ethoxylated natural fats, oils and waxes, glycol esters of fatty acids, polyoxyethylene fatty acid amides, polyalkylene oxide block copolymers, poly(oxyethylene-co-oxypropylene) and the like.

The amount of surfactant can be from about 0.1 to about 10%, and preferably from about 0.1 to about 2% by weight of the filter.

The filter can also include other agents which serve to filter or inactivate the toxic components of smoke. These include anti-oxidants and radical scavengers such as glutathione, cysteine, N-acetylcysteine, mesna, ascorbate, and N,N'-diphenyl-p-phenyldiamine; aldehyde inactivators such as ene-diol compounds, amines, and aminothiols; nitrosamine traps and carcinogen inactivators such as ion-exchange resins, chlorophyllin, and chlorophyll; and nicotine traps such as tannic acid and other organic acids.

It is preferred that the filter be provided with an exterior, circumferential, moisture-impervious barrier or casing to prevent wetting of the hands of the user. Such a barrier can be made from a polymeric material such as ethylvinyl acetate copolymer, polypropylene, or nylon.

The filter of the present invention can be provided in combination with cigarettes or cigars or other smokable devices containing divided tobacco, being secured to one end of the smokable device. The filter can also be provided by itself, for attachment to a cigarette, cigar, pipe, or the like.

Filters according to the present invention are easy to make. A solution containing the humectant, such as sodium pyroglutamate, and surfactant, can be prepared, and then the substrate can be wetted with the solution. The wetted substrate is then dried, leaving a residue of the humectant and surfactant dispersed on or in the substrate.

Filters according to the present invention have significant advantages. The materials, and preferably sodium pyroglutamate, used are non-hazardous and stable, easy to use, and yet provide the benefit of wet filtration. They can be provided integral with the filter, and in case of sodium pyroglutamate, pull out charged particles from tobacco smoke.

These and other advantages of the present invention are demonstrated by the following comparative example.

EXAMPLES 1–6

Three types of filters were tested for relative effectiveness in removing tar from cigarette smoke:

1) Conventional cellulose acetate filter (Cell-Ac).

2) Cellulose acetate with sodium pyroglutamate (NaPyro).

3) Commercial wet-filtration system (Aquafilter).

For preparation of filters containing sodium pyroglutamate, cellulosic filters weighing 0.21 grams were removed from commercial cigarettes. 0.5 ml of a 10% by weight solution of sodium pyroglutamate was applied to each filter, and the filter was dried overnight at 60° C.

Filters 1 and 2 were weighed and inserted into a 1.5 inch segment of polycarbonate tube with an inside diameter identical to the outside diameter of a standard cigarette. A filterless cigarette having 0.85 grams of tobacco was inserted into the end of the polycarbonate tube in proximity to one end of the filter. The other end of the polycarbonate tube was attached to tubing connected to a suction pump. Duplicates of each filter type were tested.

For testing of a commercial wet-filtration system, an Aquafilter with the same filterless cigarette was attached to the suction pump via a length of tubing.

The cigarettes were lit and intermittent suction, simulating inhalation of cigarette smoke, was applied until the cigarette had burned to within 0.5 inch of the unlit end.

The filters were removed from either the polycarbonate tube or from the Aquafilter, weighed, and placed in 10 ml of methanol to elute tar and other substances from the smoke that were retained in the filter.

Light absorbance (at a wavelength of 350 nm) of the ethanolic filter eluates was used as an index of the amount of smoke components retained on the filters. The weight gained by the filters during smoke passage was also recorded. The results of the test are presented in Table 1.

| EXAMPLE | FILTER | ABSORBANCE at 350 nm | Weight Gain |
|---|---|---|---|
| 1 | Cell-Ac | 0.470 A.U. | 35 mg |
| 2 | Cell-Ac | 0.381 A.U. | 30 mg |
| 3 | NaPyro | 0.731 A.U. | 71 mg |
| 4 | NaPyro | 0.625 A.U. | 60 mg |
| 5 | Aquafilter | 0.540 | * |
| 6 | Aquafilter | 0.560 | * |

*The weight gain due to absorbance of smoke components on the Aquafilter could not be determined, since the Aquafilter actually lost weight during passage of smoke, presumably due to evaporation of water.

Based on the absorbance data, the filters according to the present invention (Examples 3 and 4) are significantly more effective than the filters without the humectant (Examples 1 and 2), and also more effective than the Aquafilter (Examples 5 and 6). The weight gain data also demonstrates the increased effectiveness of the filter according to the present invention (Examples 3 and 4) as compared to an ordinary cellulose acetate filter (Examples 1 and 2).

Although the present invention has been discussed in considerable detail with reference to certain preferred versions thereof, other versions are possible. Therefore, the spirit and scope of the appended claims should not be limited to the description of the preferred versions contained herein.

What is claimed is:

1. A method of making a filter for a smokable device, comprising the steps of:

(a) providing a porous substrate;

(b) dispersing a humectant therein; and (c) drying the substrate containing dispersed humectant to remove water leaving a residue of dry humectant;

wherein the humectant is sodium pyroglutamate.

2. The method of claim 1, further comprising the step of adding a surfactant to the substrate.

3. The method of claim 2, wherein the surfactant is selected from the group consisting of ethoxylates, carboxylic acid esters, glycerol esters, polyoxyethylene esters, anhydrosorbitol esters, ethoxylated anhydrosorbitol esters, ethoxylated natural fats, oils, and waxes, glycol esters of fatty acids, polyoxyethylene fatty acid amides, polyalkylene oxide block copolymers and poly (oxyethylene-co-oxypropylene).

4. The method of claim 2, wherein the surfactant is present in an amount of from about 0.1 to about 10% by weight of the filter.

5. The method of claim 1, wherein the porous substrate is dry.

6. A smokable device, comprising a filter affixed to a body of divided tobacco, wherein the filter includes a porous substrate having dry sodium pyroglutamate dispersed therein and wherein the filter further includes a surfactant.

7. The smokable device of claim 6, wherein the sodium pyroglutamate is present in an amount from about 5 to about 60% by weight of the filter.

8. The smokable device of claim 6, wherein the surfactant is selected from the group consisting of ethoxylates, carboxylic acid esters, glycerol esters, polyoxyethylene esters, anhydrosorbitol esters, ethoxylated anhydrosorbitol esters, ethoxylated natural fats, oils, and waxes, glycol esters of fatty acids, polyoxyethylene fatty acid amides, polyalkylene oxide block copolymers and poly (oxyethylene-co-oxypropylene).

9. The smokable device of claim 6, wherein the surfactant is present in an amount of from about 0.1 to about 10% by weight of the filter.

10. The smokable device of claim 6, wherein the porous substrate is dry.

* * * * *